US007654183B2

(12) United States Patent
Marks

(10) Patent No.: US 7,654,183 B2
(45) Date of Patent: Feb. 2, 2010

(54) COMPACT HEAVY DUTY HOLE PUNCH

(75) Inventor: Joel S. Marks, Sherman Oaks, CA (US)

(73) Assignee: WorkTools, Inc., Chatsworth, CA (US)

( * ) Notice: Subject to any disclaimer, the term of this patent is extended or adjusted under 35 U.S.C. 154(b) by 0 days.

(21) Appl. No.: 11/386,338

(22) Filed: Mar. 22, 2006

(65) Prior Publication Data

US 2007/0199424 A1 Aug. 30, 2007

Related U.S. Application Data

(60) Provisional application No. 60/761,492, filed on Jan. 23, 2006.

(51) Int. Cl.

| | |
|---|---|
| ***B26D 5/08*** | (2006.01) |
| ***B26D 5/18*** | (2006.01) |
| ***B26F 1/14*** | (2006.01) |
| ***B26B 17/00*** | (2006.01) |

(52) U.S. Cl. ..... 83/618; 83/633; 83/687; 83/630; 30/189

(58) Field of Classification Search ..... 83/618, 83/634, 633, 687, 605, 691, 167, 683, 589, 83/620, 627, 630; 30/353, 363, 181, 189, 30/183, 204, 215, 216, 217, 218, 219, 220; 16/277, 255

See application file for complete search history.

(56) References Cited

U.S. PATENT DOCUMENTS

| | | | | |
|---|---|---|---|---|
| 1,613,766 | A * | 1/1927 | Parcher | 83/687 |
| 1,962,193 | A * | 6/1934 | Heise | 30/363 |
| 2,032,730 | A * | 3/1936 | Welk | 83/468.93 |
| 2,120,682 | A * | 6/1938 | Sharp | 30/363 |
| 2,405,150 | A | 8/1946 | Kern | |
| 2,770,833 | A * | 11/1956 | Drechsel | 16/255 |
| 3,005,371 | A | 10/1961 | Mission | |
| 3,077,805 | A * | 2/1963 | Stanley | 83/384 |
| 3,392,447 | A * | 7/1968 | Hendricks et al. | 30/363 |
| 3,469,486 | A | 9/1969 | Neilsen | |
| 3,485,130 | A | 12/1969 | Neustadter et al. | |
| 3,714,857 | A | 2/1973 | Stuertz et al. | |
| 3,842,650 | A * | 10/1974 | Hartmeister | 72/409.01 |
| 3,921,487 | A * | 11/1975 | Otsuka et al. | 83/468.9 |
| 4,077,288 | A * | 3/1978 | Holland | 83/146 |
| 4,166,404 | A | 9/1979 | Almog | |

(Continued)

OTHER PUBLICATIONS

U.S. Appl. No. 11/215,423, filed Aug. 30, 2005, Marks.

(Continued)

*Primary Examiner*—Ghassem Alie
*Assistant Examiner*—Bharat C Patel
(74) *Attorney, Agent, or Firm*—Paul Y. Feng; Fulwider Patton LLP

(57) ABSTRACT

A compact hole punch device includes a generally vertical entry paper slot with an elongated handle hinged at one end of the punch device extending toward the opposite end of the device along side the paper slot. A chip chamber extends along the punch device opposite the slot from the handle. A roller cam mechanism concentrates forces in a small area of the device to provide a very compact, rigid action. An elongated chip tray is pivotably attached to the chip chamber including a lowered position where chips are easily emptied out an open distal end of the tray.

9 Claims, 9 Drawing Sheets

U.S. PATENT DOCUMENTS

| | | | | | |
|---|---|---|---|---|---|
| 4,291,464 | A | * | 9/1981 | Garrett | 30/363 |
| 4,594,927 | A | * | 6/1986 | Mori | 83/620 |
| 4,713,995 | A | * | 12/1987 | Davi | 83/167 |
| 4,757,733 | A | | 7/1988 | Barlow | |
| 5,007,782 | A | * | 4/1991 | Groswith et al. | 412/40 |
| 5,163,350 | A | * | 11/1992 | Groswith et al. | 83/549 |
| 5,273,387 | A | * | 12/1993 | Groswith et al. | 412/40 |
| 5,431,519 | A | * | 7/1995 | Baumann | 412/40 |
| 5,460,313 | A | | 10/1995 | Magnusson et al. | |
| 5,463,922 | A | | 11/1995 | Mori | |
| 5,632,188 | A | | 5/1997 | Karlis | |
| 5,730,038 | A | * | 3/1998 | Evans et al. | 83/686 |
| 5,778,750 | A | | 7/1998 | Drzewiecki et al. | |
| 5,829,334 | A | | 11/1998 | Evans et al. | |
| 6,032,566 | A | | 3/2000 | Evans et al. | |
| 6,050,686 | A | * | 4/2000 | De Rossi | 351/153 |
| 6,089,137 | A | * | 7/2000 | Lee | 83/621 |
| 6,269,721 | B1 | | 8/2001 | Tseng | |
| 6,374,715 | B1 | | 4/2002 | Takatsuka | |
| 6,470,575 | B2 | * | 10/2002 | Huang | 30/250 |
| 6,622,908 | B2 | | 9/2003 | Fukumoto et al. | |
| 6,688,199 | B2 | * | 2/2004 | Godston et al. | 83/167 |
| 6,862,875 | B2 | * | 3/2005 | Iida et al. | 56/320.2 |
| 6,918,332 | B1 | * | 7/2005 | Andersen | 83/589 |
| 7,011,008 | B2 | * | 3/2006 | McLean et al. | 83/605 |
| 2003/0160094 | A1 | | 8/2003 | Ko | |
| 2004/0231100 | A1 | | 11/2004 | Schultz et al. | |
| 2006/0150790 | A1 | | 7/2006 | Ko | |
| 2007/0056422 | A1 | * | 3/2007 | Lee | 83/582 |
| 2007/0107576 | A1 | * | 5/2007 | Chen | 83/669 |

OTHER PUBLICATIONS

International Search Report, Nov. 28, 2007, pp. 1-2.

* cited by examiner

COMPACT HEAVY DUTY HOLE PUNCH

This application claims priority from U.S. Provisional Application No. 60/761,492, filed on Jan. 23, 2006, the contents of which are hereby incorporated by reference in their entirety.

FIELD OF THE INVENTION

The present invention relates to hole punching devices. More precisely, the present invention relates to a compact rigid structure to actuate a punch pin through thin sheets.

BACKGROUND OF THE INVENTION

Punching devices are known for applications such as paper punching. It is desirable to minimize the force required to operate the punch. This may be accomplished by improving efficiency of the punch system and by increasing the available leverage. In general, a large punch device can provide large capabilities, or equivalently can provide easy operation in regular use. However, for ordinary use, a practical punch device should be compact and have a small footprint to suit an individual or office worker's desktop.

In a manually actuated punch device a user presses a handle. It is desirable to minimize the force required at the handle to cut a hole into a stack of papers. According to one improvement, force may be reduced directly at the pin. Such improvements are among those disclosed in co-pending U.S. patent application Ser. No. 11/215,423, filed Aug. 30, 2005, titled "Hole Punch Element" by Joel S. Marks, whose entire contents are hereby incorporated by reference.

Another solution to reduced actuation force is in the design of operating levers or other movable parts to link the handle to the pin. Generally, a longer handle stroke with an associated longer hand motion provides increased leverage and reduced force. In a common design for a manual punch, the handle is pressed downward toward a tabletop that supports the device. For a comfortable action, the longest possible handle should be used, where the handle length is defined as the distance between a handle hinge and a hand pressing area.

In contrast, a short handle provides a limited handle stroke since, in the extreme, a short handle quickly becomes vertical in an upper position. As a result, a downward pressing action cannot easily actuate a vertically-oriented handle unless the handle is pushed sideways first. A long handle moved to the same upper position to provide the same handle stroke would still be partially horizontal. Thus, the longer handle can readily be pressed downward. Yet the handle cannot be arbitrarily long if a reasonably sized punch device is to be preserved.

Various designs are known to attempt to provide a useful handle stroke. A further advantage of a long handle is the user's hand remains more upon the same part of the handle since there is minimal angle change. A short handle with large angle change causes the user's hand to roll toward the handle hinge on the handle pressing area. This reduces the user's leverage on the handle.

A typical punch device has an elongated body with a horizontal paper slot. A handle hinges about an axis parallel to the length of the punch with the handle being pressed downward near a center of its length. The handle directly presses the tops of the pins. An example of this type of punch is shown in U.S. Pat. No. 5,778,750 (Drzewiecki et al.) in FIGS. 1 and 1A. A further example is shown in U.S. Pat. No. 3,485,130 (Neustadter). With the proportions shown, the Neustadter '130 punch has a longer handle stroke than that of the Drzewiecki '750 punch of FIG. 1A. However, the footprint of the Neustadter '130 punch is larger (to the left in FIG. 2) to provide a support for downward pressing on the distal end of handle 14.

Another example of a typical punch device is shown in U.S. Pat. No. 4,757,733 (Barlow). In FIG. 6, ridge 40 "transmits pressure" to cap 47 atop each pin. Helical spring 45 surrounds the pin.

U.S. Pat. No. 3,714,857 (Stuertz et al.) and U.S. Pat. No. 2,405,150 (Kern) show another type of handle and linkage. A cantilevered bar extends from one end of the device. As with Neustadter '130 above, the base must be extended to be underneath the handle's pressing end. In Stuertz '857, it is clear especially in the plan view of FIG. 1 how large a footprint is needed to accommodate the extended handle.

Another punch design uses a handle that is co-extensive with the body of the punch device. For example, in U.S. Pat. No. 4,166,404 (Almog), a short lever extends from one end toward the center of the hole punch, which punch has a horizontal paper slot. A longer lever extends from a second end over the first lever and to the first end to a distal pressing area. This design is suited only for a two hole punch since there is no means to apply leverage to a center pin.

Still another design with a co-extending handle is shown in U.S. Pat. No. 5,163,350 (Groswith, III et al.). In this design, a parallelogram type linkage provides pressing forces at multiple locations. U.S. Pat. Nos. 5,829,334 and 6,032,566 (Evans et al.) describe a further co-extensive type handle used in a punch. The Evans punch includes a second handle pivoted near the center of the device about a perpendicular axis to that of the conventional handle. The second handle co-extends with the length of the device and provides increased handle stroke. However, the second handle is much shorter than the length of the punch device because of the central pivot location.

In any punch device it is important to maximize efficiency. One reason is that given a level of effort or input force generated by the user on the operating handle, an efficient hole punch can easily cut through more dense and/or a thicker stack of papers or sheet media. Indeed, friction should be reduced throughout the assembly. In most of the conventional designs, the various moving parts encounter substantial sliding friction.

SUMMARY OF THE INVENTION

The present invention in a preferred embodiment is directed to a hole punch device that is used to cut one or more holes in a stack of sheet media such as paper. In the preferred embodiment, the punch device provides a large handle stroke in a very compact, low friction device. In this preferred embodiment, the handle is co-extensive with an elongated body, with the handle spanning substantially the full length of the body. The handle pressing area is at one end of the body while the handle hinge is at an opposite end of the body. The long handle enables a large, comfortable handle stroke as defined by the distance the pressing area moves through that stroke. Also, through the stroke there is minimal angle change so the same portion of the pressing area remains in contact with the user's hand as the handle moves downward. A longer handle approaches the effect of a linear action of a pushbutton at the pressing area.

A conventional shorter handle, in contrast, incurs a larger angle change. The user's hand tends to roll slightly along the pressing area toward the hinge through the stroke. Therefore, near the end of the stroke the handle becomes effectively shorter as the hand presses more near to the hinge. Lower leverage results. For a same handle stroke distance, this effect is reduced with the present embodiment longer handle.

The present invention punch device preferably employs a cam-roller linkage that provides a very compact means to convert a large translating motion from the handle into a higher force translating motion delivered to one or more hole punch pins. In the preferred embodiment, the rollers are loosely confined, as contrasted with wheels that are confined upon a fixed axle. But optionally, rollers or wheels with axles may be used. The rollers are pressed between two parts that move past each other. The parts can thus move against each other with near zero friction. If the parts include optional raised or lowered areas at the rollers, the parts can move relatively toward or away from each other.

Beneficially, the cam-roller linkage provides a rigid, compact mechanism with high forces concentrated in small areas of the device. A rigid punch device is more preferable for a reliable and high quality action. Any significant flexing of a punch device during normal use causes the action to feel indefinite and of low quality.

In a preferred embodiment cam-roller linkage, a cam is linked to the handle at one end and engages the punch pins at another end, via further elements. The rollers follow a profile that is on the cam. As a result, the cam profile translates to a force profile that is customized to closely match the available input force to the changing requirements at the punch pins.

For example, there may be a large, low force take-up motion or stroke at the punch pin as the pin moves from a rest position to a position at which cutting begins. To address this condition, the cam may be configured with a steep profile to move the pin rapidly into its position pressing the paper sheets. During the following cutting stroke, high force is typically required. To address this condition, the cam is configured with a shallower profile through the cutting portion. A final, steep cam profile moves the pin to a final position to eject paper chips.

In conventional, horizontally-fed hole punch devices, the punch pins move vertically during the cutting stroke, in the same direction as the actuation handle. In contrast, the preferred embodiment hole punch has horizontally-oriented punch pins that move horizontally in the cutting stroke, yet the actuation handle still moves vertically. To achieve this redirection of force, the preferred embodiment punch device employs a low friction mechanism for transferring the vertical force of the handle to the horizontal force acting on the cutting pins. As a result, the present invention hole punch device may have a generally vertically-oriented paper slot to receive papers vertically therein to be cut by the horizontally-acting pins. One advantage is that the vertically-oriented slot results in a hole punch device having a smaller foot print. A second advantage is that since the papers to be punched are fed vertically into the hole punch device, there is again a savings in desktop surface space.

The term "paper" is used broadly to include all sheet media suitable for hole punching, including single or stacked sheets, and/or multiple laminated layers of paper, cardboard, metal, plastic, film, cork, felt, rubber, etc. Likewise, the expression "vertical entry" contemplates a vertical orientation and includes all angles moderately off precisely vertical.

The handle is long and preferably extends atop the punch along side nearly the entire length of the paper slot, yet the punch device is compact in size and in use. In most preferred embodiments, the punch occupies negligible additional foot print to support use of the long handle, and no additional desk space to insert the paper. The handle includes an optional latch to lock the handle in its lowest position for compact storage.

The preferred embodiment hole punch also has a large handle stroke that is produced by a small, compact device, and the operating forces are evenly spread within the frame of the hole punch. As a result, the hole punch may be configured for heavy-duty use yet maintain a very compact overall package. Heavy-duty use implies paper capacities greater than twelve pages, for example. In its most compact configuration, when the handle is latched or held down next to the body of the punch, the hole punch device may be carried easily in one hand. The benefits of the present invention may also be applied to a motorized punching device, or to a paper cutter wherein a straight-edged cutting blade replaces the punch pins.

In a preferred embodiment, an elongated chip tray extends parallel to the paper slot. A chamber of the punch body is open along the bottom. The tray encloses the underside of the chamber. It selectively pivots downward to expose an open top with an open distal end. With the tray well exposed in the open, down position, cuttings or chips are easily accessed for removal. The tray preferably includes a slight draft angle increasing toward the open end to help empty the well by enabling the cuttings or chips to slide out from the tray.

DETAILED DESCRIPTION OF THE PREFERRED EMBODIMENTS

Figures 1, 2:
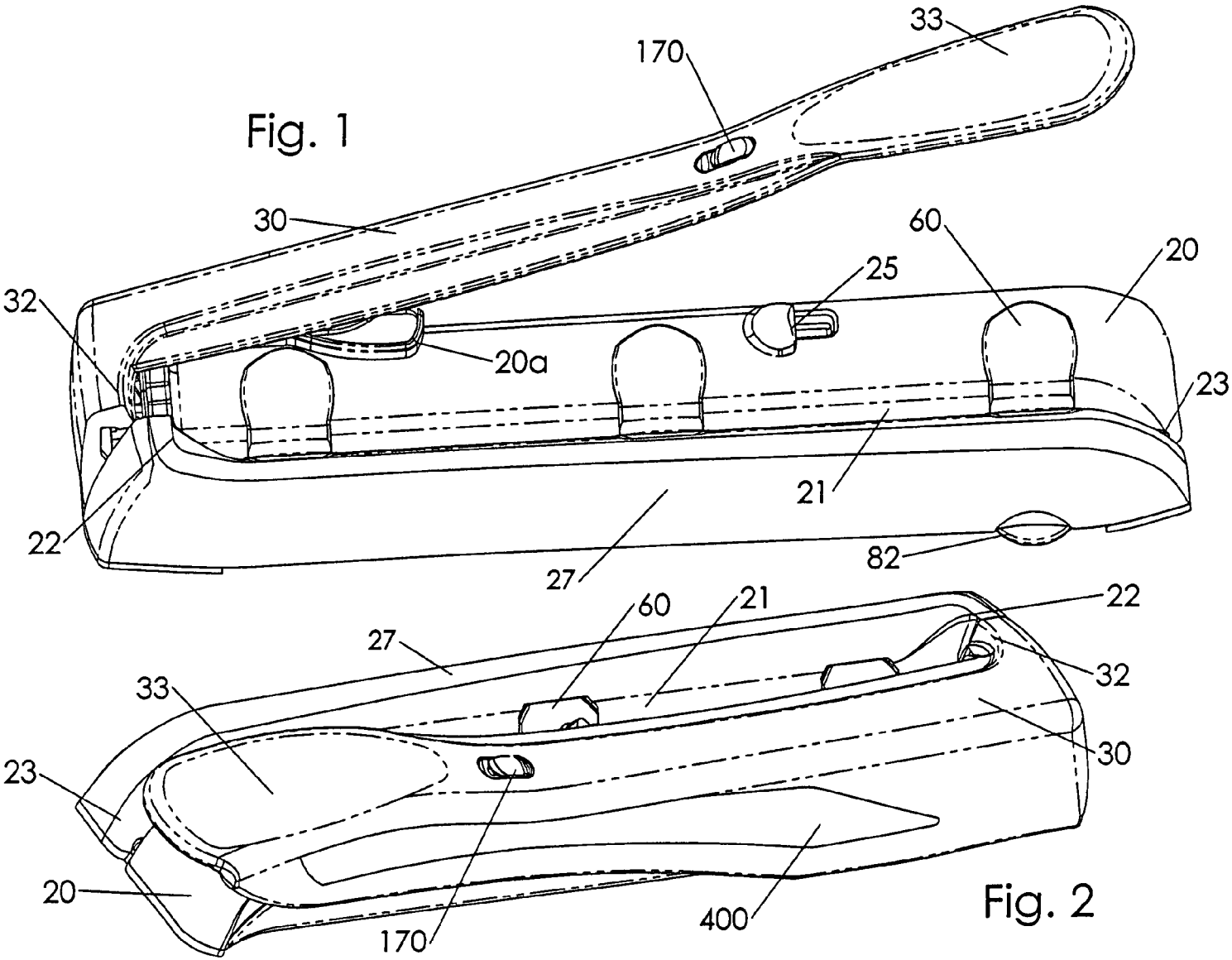
FIG. 1 is a front, top perspective view of a hole punch in a rest position according to one exemplary embodiment of the invention.
FIG. 2 is a top, back side perspective view of the hole punch of FIG. 1, in a pressed position.

The hole punch device of the present invention in a preferred embodiment provides a compact, high performance cutting tool using an efficient arrangement of levers and cams. FIG. 1 is a front upper perspective view of a preferred embodiment hole punch device having handle 30 shown in an upper most rest position. The hole punch device has a vertically or near vertically oriented sheet media or paper insertion slot 21. With this orientation, no additional desk or work area space is required when the papers are placed in position to be hole punched. According to alternative embodiments (not shown), the paper insertion slot 21 may be oriented horizontally, exposed for example, downward and out of the page in the view of FIG. 1, or the paper insertion slot may be oriented at an angle. Although papers are a common use for the hole punch device, other sheet or laminate materials or media may be punched or cut, including plastic, metal, or combinations thereof.

FIG. 2 is the hole punch device of FIG. 1 rotated 180° clockwise to show the back upper side. In FIG. 2, handle 30 is pressed to a lower most pressed position. In the pressed position, optional latch 170 may be engaged to hold handle 30 for compact carriage and storage in the lower most position. The hole punch device can then be grasped fully around the central area and thus be easily carried. Also optionally, latch 170 remains disengaged in the pressed position while handle 30 is naturally held down during transport.

Punch elements 60 are spaced along paper insertion slot 21; three such punch elements 60 create a three-hole punch as shown in the drawings. More or fewer punch elements 60 including a single punch element may be provided to create more or fewer holes in the sheet media. Also, the spacing between punch elements may be fixed as is shown in the preferred embodiment. In an alternative embodiment, the spacing between punch elements may be adjusted by moving one or more punch elements and locking them to the hole punch device frame, housing, or the like, via wing nuts, thumb screws, clamps, spring-loaded locating pins, etc. Insertion slot 21 extends from closed end 22 to open end 23. Optionally, both ends 22, 23 may be open or closed.

Handle 30 includes pressing area 33 and optional enclosing surface 32 spanning closed slot end 22. Latch 170 selectively engages rib 25 at hook 171 (FIGS. 14, 18) to lock handle 30 in the lower most position.

Punching Operation Sequence of Events

Figure 3:
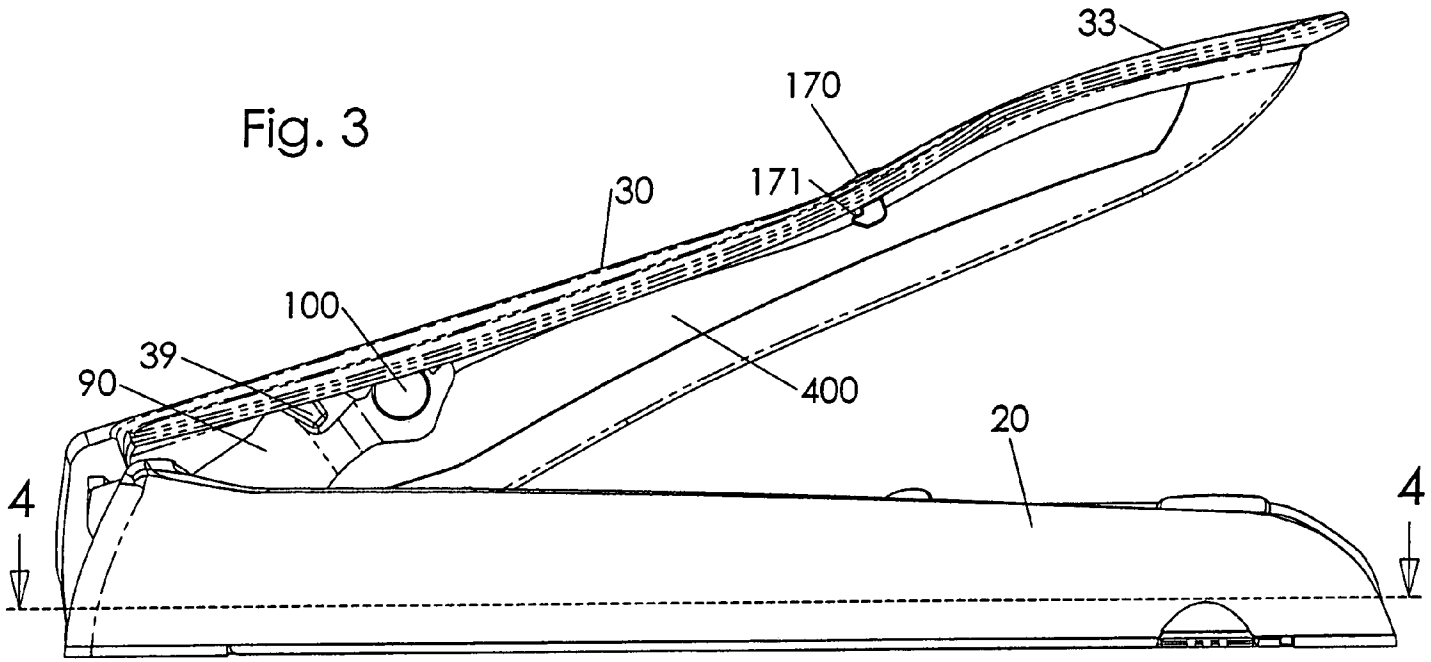
FIG. 3 is a front elevational view of the hole punch of FIG. 1.
Figure 4:
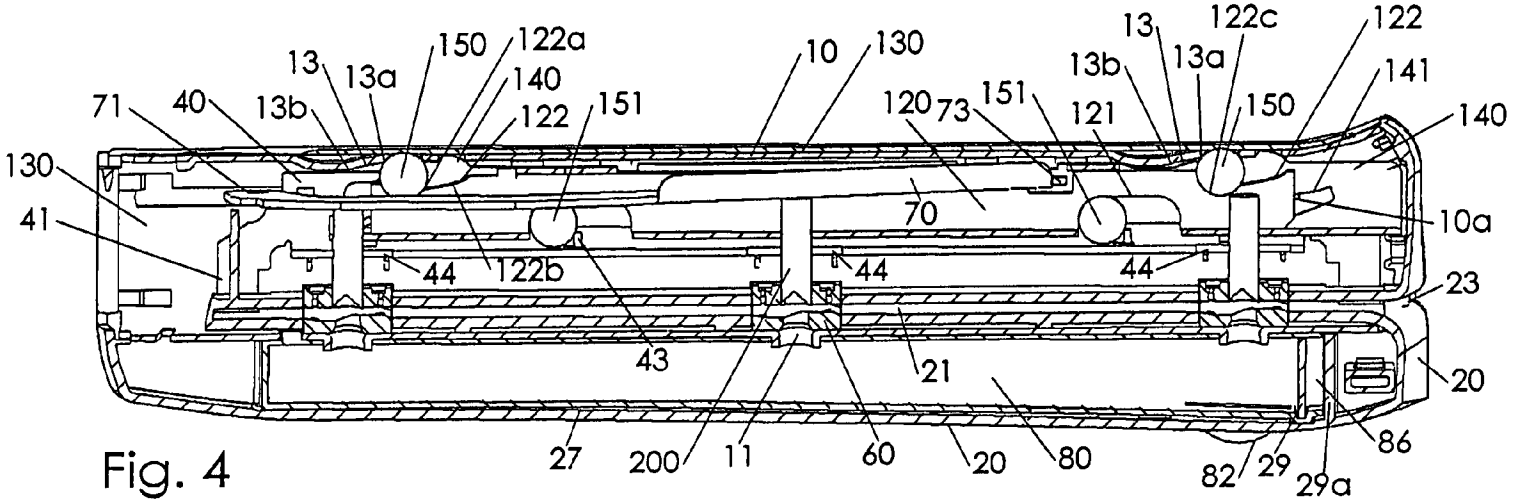
FIG. 4 is a top plan view of the hole punch of FIG. 3, partially in cross-section taken along line 4-4 of FIG. 3 exposing the horizontally oriented cutting pins 200.
Figure 6A:
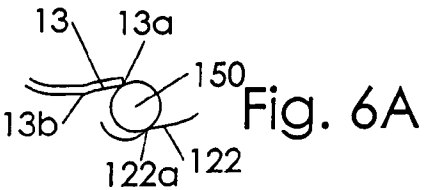
FIG. 6A is a detail view of a roller 150 in an intermediate operating position.

FIG. 3 is a front elevational view of the preferred embodiment hole punch device. FIG. 4 is a top plan view of the hole punch device of FIG. 3, partially in cross-section taken along line 4-4 of FIG. 3. As seen in FIGS. 3 and 4, handle 30 is linked to horizontally-oriented cutting pins 200 via lever 90, cam 120, rollers 150, and tie bar 40. Isolated views of these components are shown in, for example, FIG. 20 for handle 30, FIG. 21 for lever 90, FIG. 23 for cam 120, FIG. 6A for roller 150, and FIG. 24 for tie bar 40. Lever 90 and handle 30 are separately or independently movable.

Figure 13:
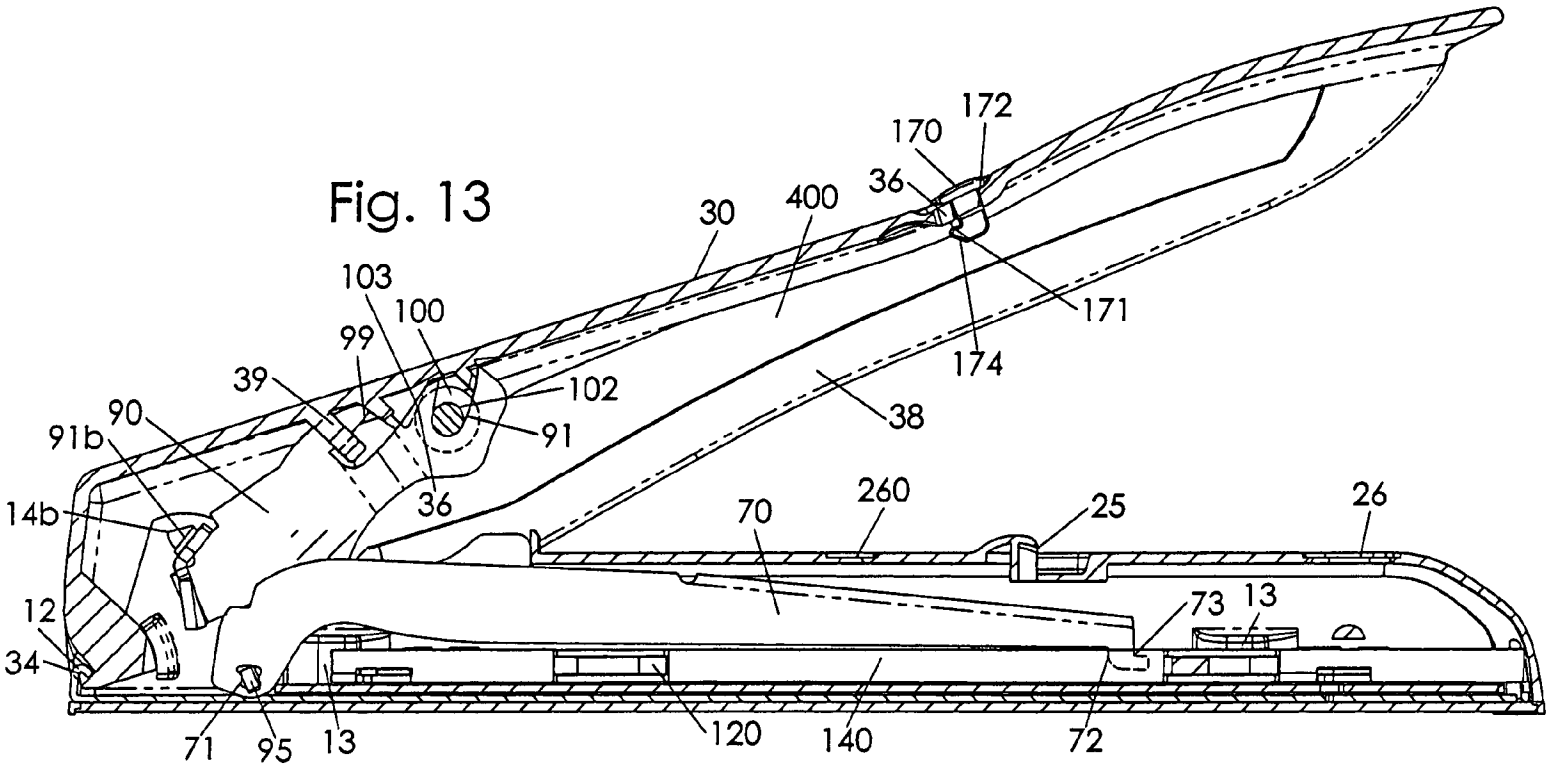
FIG. 13 is a front elevational view, shown in cross-section, of the hole punch device having its handle 30 in the rest position and depicting action of lever 90.
Figure 14:
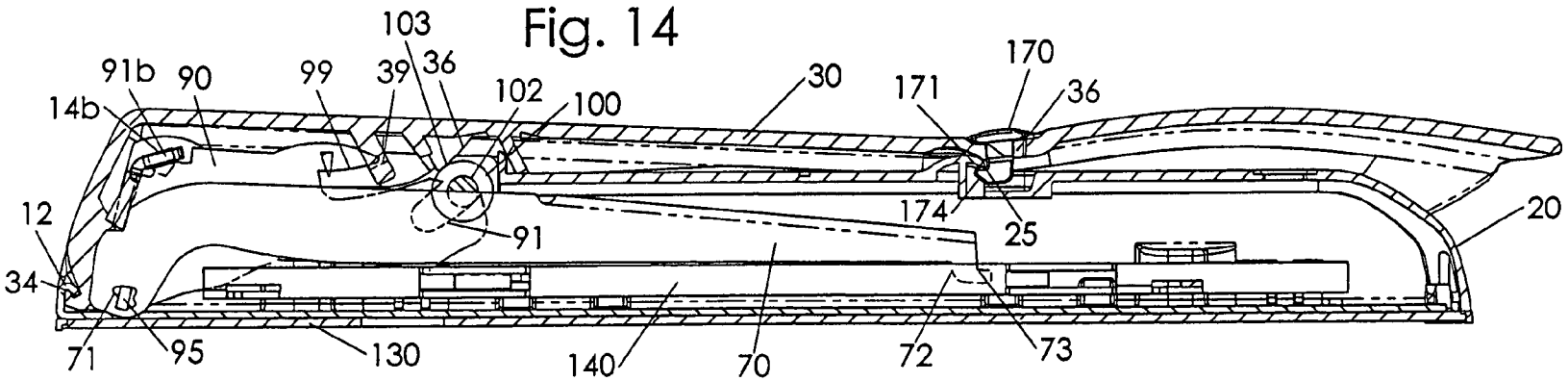
FIG. 14 depicts the same view as FIG. 13, but with the hole punch device having its handle 30 in the pressed position and depicting the action of lever 90.
Figure 17:
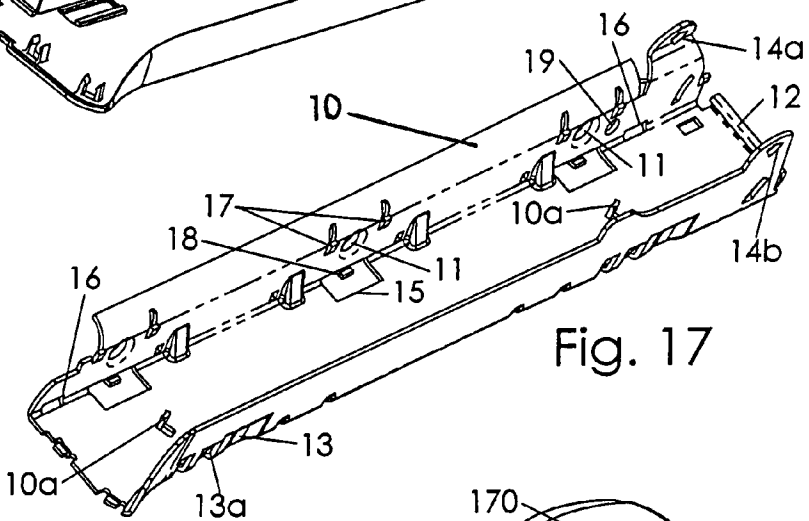
FIG. 17 is a top perspective view of frame 10.
Figure 21:
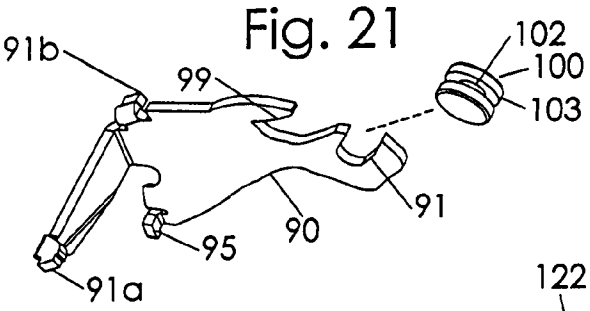
FIG. 21 is an exploded view of an assembly of lever 90 and roller 100.

FIGS. 13 and 14 provide cross-sectional views of the action of lever 90 and handle 30. Lever roller 100 rolls along ramp or cam 36 of handle 30 and edge 91 of lever 90. FIG. 21 is an isolated assembly view of lever 90, lever roller 100, and edge 91. Handle 30 is hinged at rib 34 of elongated hinge tab 12 of frame 10 at or near to one end of the hole punch device. FIG. 17 is an isolated view of frame 10 with elongated tab 2.

Figure 7:
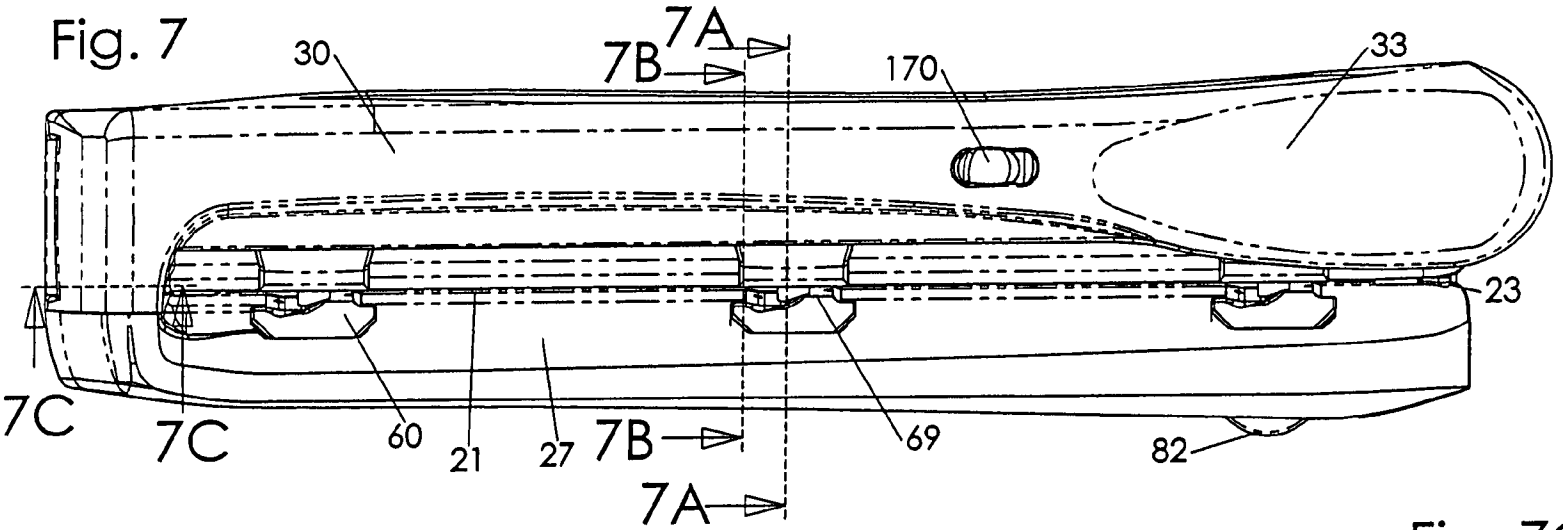
FIG. 7 is a top plan view of the hole punch of FIG. 5 showing a portion of three punch elements 60, punch element slots 69, and paper insertion slot 21.

Hinge tab 12 with rib 34 define a substantially horizontally oriented pivoting axis for handle 30. This pivoting axis extends in a direction parallel to the 7C-7C cross-section arrows in FIG. 7, which axis cuts perpendicularly across the elongated opening of slot 21. By this arrangement, as seen in FIG. 7, the elongated handle and the elongated frame have a stacked arrangement making for a very compact hole punch device.

In comparing FIG. 13 to FIG. 14, it is seen that lever 90 rotates more than handle 30 between the rest and pressed positions, respectively, which define the punching stroke. Generally speaking, lever 90 rotates about 45° while handle 30 rotates about 30° from the view in FIG. 13 to the view in FIG. 14. This difference in angular movement of handle 30 versus lever 90 translates to mechanical advantage, discussed in more detail below.

Figure 22:
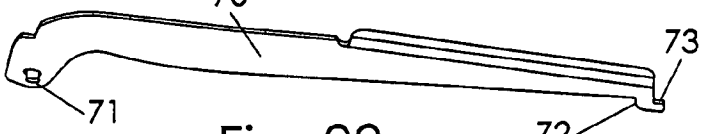
FIG. 22 is a top perspective view of link 70.

Tab 95 of lever 90 engages opening 71 of link 70 as shown in FIGS. 13 and 14. In the detail views of FIGS. 7C and 7D, it can be seen that tab 95 of lever 90 extends through and hooks into opening 71 of link 70. Link 70 is shown in an isolated view in FIG. 22. In the preferred embodiment, lever 90 is assembled to link 70 by inserting tab 95 into opening 71 with the two components positioned 90° to each other. Then lever 90 is rotated into the position shown in FIG. 7D. The interaction between tab 95 and opening 71 is similar to a key extending through a keyhole. In this manner, a simple pivoting linkage is created.

Figure 8:
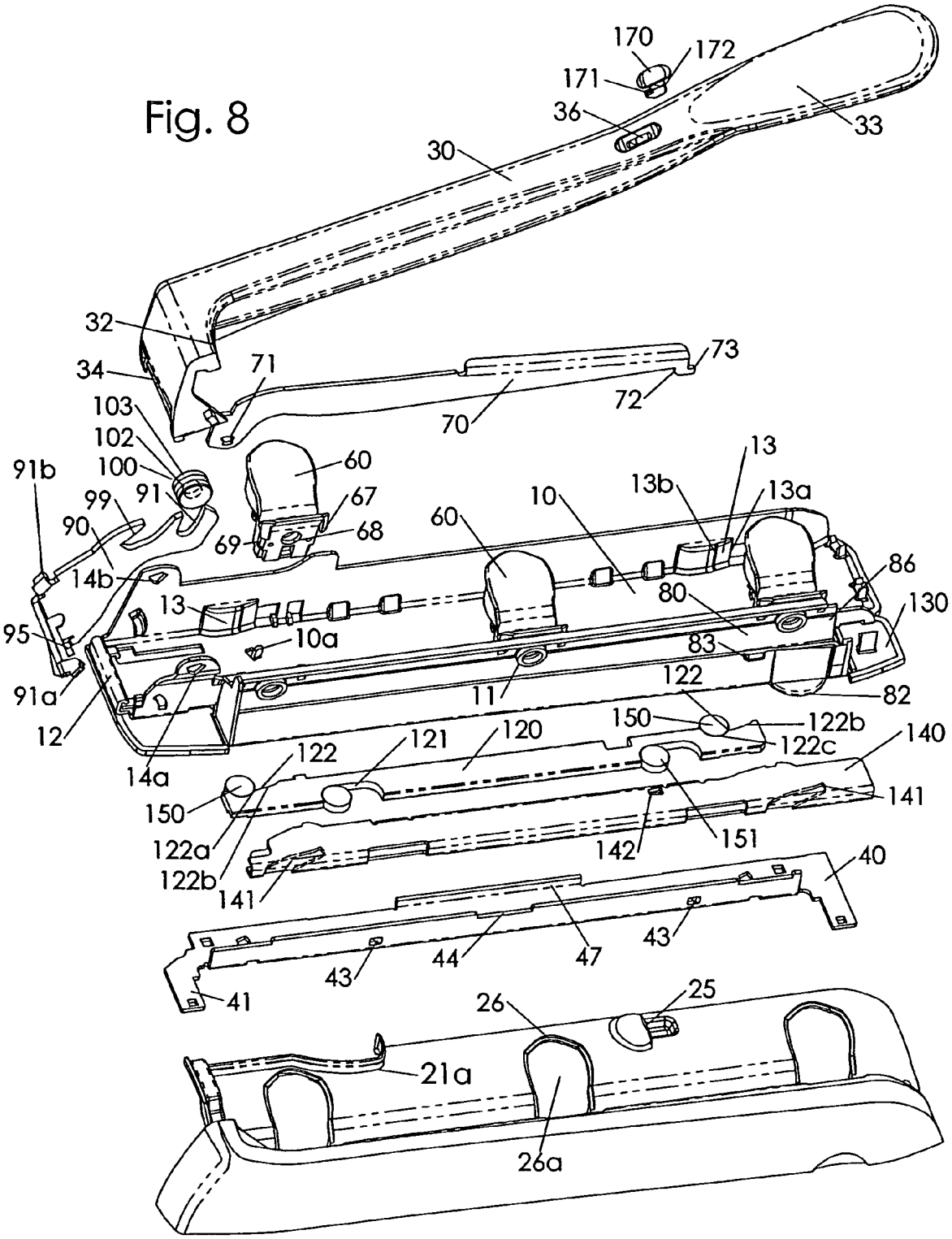
FIG. 8 is an exploded view of the exemplary embodiment hole punch device of FIG. 1.
Figure 25:
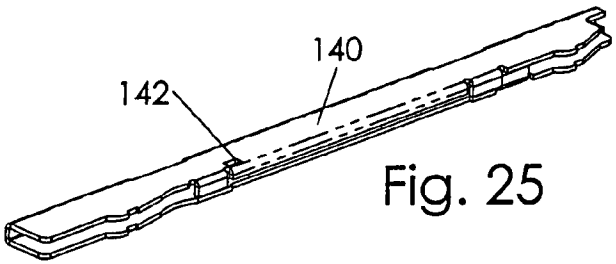
FIG. 25 is a top perspective view of roller cage 140.
Figure 27:
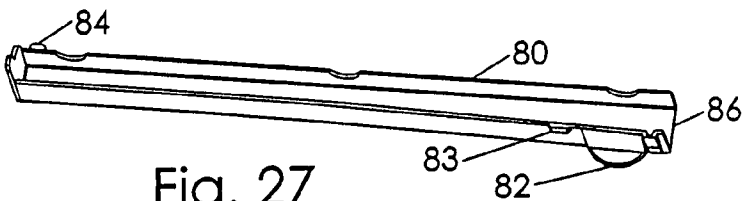
FIG. 27 is a top perspective view of chip tray 80 used for collection and storage of cut chips.
Figure 26:
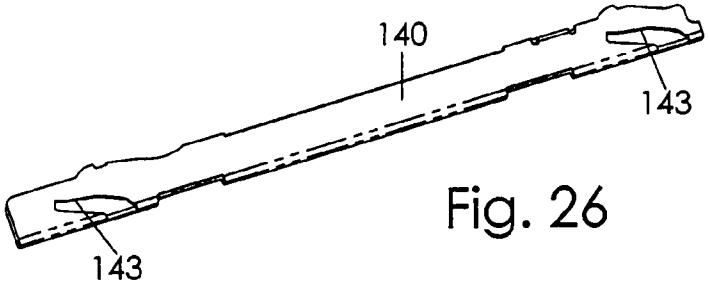
FIG. 26 is a perspective view of roller cage 140 of FIG. 25, rotated 180° about its long axis to show its bottom side.

Pressing handle 30 downward actuates lever 90 whose movement in turn causes link 70 to move to the left or laterally in FIG. 14. Link 70 next pulls roller cage 140 to the left at tab 72 in opening 142 of roller cage 140, as best seen in the exploded view of FIG. 8. FIGS. 25 and 26 are isolated views of roller cage 140. Tab 72 is held to roller cage 140 by extension 73 (FIGS. 8 and 13). The assembly and operation of tab 72/extension 73 within opening 142 are similarly to hooking tab 95 to opening 71 for the lever 90 to link 70 pivot. This is again analogous to a key and keyhole arrangement.

Figure 23:
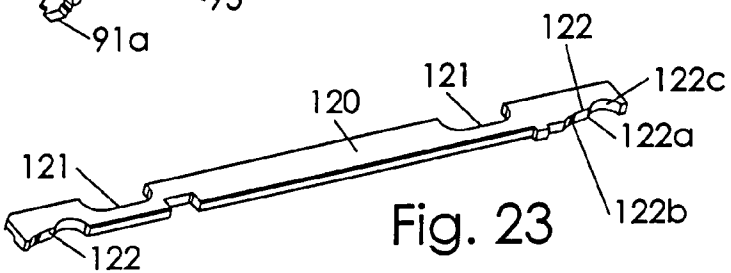
FIG. 23 is a perspective view of cam 120.

Cam 120 is fitted within roller cage 140 (FIG. 8) so there is no relative movement between the two parts. FIG. 23 is an isolated view of cam 120. In the action depicted in FIGS. 13 and 14, pressing handle 30 through a sequence of linkages ultimately forces cam 120 to move laterally (to the left in FIGS. 13, 14) from the rest position of the cam toward a pressed position of the cam. Cam 120 thereby acts upon further components of the assembly, best seen in FIGS. 4 and 6.

In the rest position of handle 30 in FIGS. 3 and 4, cam 120 is in a farthest right position. Roller 150 rests between ramp 122 of cam 120 and ramp 13 of frame 10. Roller 150 is a non-sliding link or interface at ramp 13 of frame 10. FIG. 17 is an isolated view of frame 10. As handle 30 is pressed, the punch device moves from the rest position of FIGS. 3 and 4 toward the pressed handle position of FIGS. 5 and 6. Roller 150 rolls against the respective frame and cam ramps 13, 122, forcing cam 120 away from frame 10, downward and to the left from FIG. 5 to FIG. 6.

The downward and lateral movements of cam 120 occur concurrently in most instances and sometimes independently depending on where the handle stroke is. The downward component of the cam motion is called "axial" movement to be consistent with the axial motion of cutting pins 200 that is the intended result. That is, the axial component of the movement of cam 120 is what drives cutting pins 200.

Preferably, cam ramp 122 and frame ramp 13 are of similar profile. Then at any position of the assembly, roller 150 is pressed directly across its diameter so that the roller is stable and cannot slide out of position. Optionally, cam 120 and roller cage 140 are formed of a single piece, for example of a die cast material, since these two respective parts do not normally move in relation to each other except during assembly. In this embodiment, the combined assembly functions as a cam and may be referred to in the following as a cam.

Figure 7C:
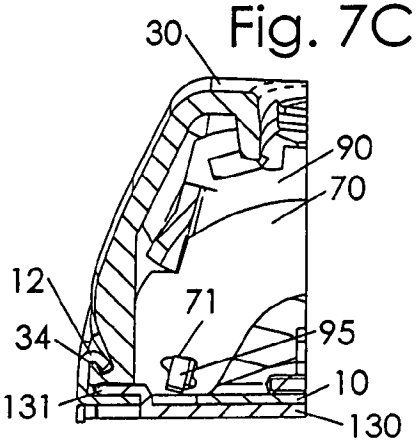
FIG. 7C is a partial cross-sectional view at a handle hinge end of the hole punch device taken along line 7C-7C of FIG. 7.
Figure 7D:
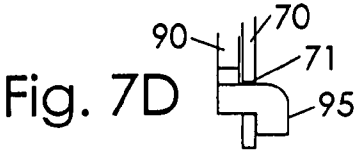
FIG. 7D is a detail view, rotated 90° from FIG. 7C, showing a lever-to-link engagement.
Figure 7B:
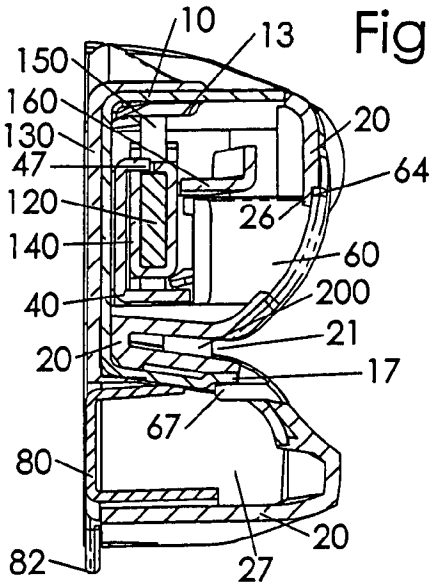
FIG. 7B is a cross-sectional view adjacent to the location of the cross-sectional view of FIG. 7A taken along line 7B-7B, wherein the hole punch device in the cross-sectional view is rotated 90° clockwise.
Figure 7A:
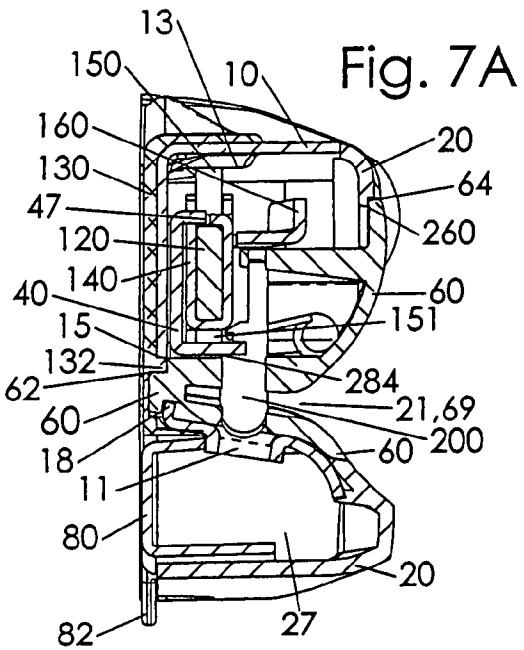
FIG. 7A is a cross-sectional view across a center of the hole punch device of FIG. 7 taken along line 7A-7A, wherein the hole punch device in the cross-sectional view is rotated 90° clockwise so its bottom is to the left and the top is to the right.

FIGS. 7A and 7B are cross-sectional views taken along lines 7A-7A and 7B-7B of the plan view of the hole punch device in FIG. 7, wherein the cross-sectional views have been rotated 90° clockwise. Cam 120 is linked to tie bar 40, as seen in FIGS. 7A, 7B, 8, and FIG. 24 provides an isolated view of tie bar 40. Tie bar 40 is linked to cutting pins 200 through slot 284 of the cutting pins. This preferred linkage design is discussed in further detail in co-pending application Ser. No. 11/215,423, whose entire contents are hereby incorporated by reference. Tie bar 40 is thus pressed substantially in the axial direction of cutting pins 200.

In summary, in the actuation or cutting stroke, a user presses on handle 30 to actuate lever 90 to undergo a lateral and rotational motion, which actuates link 70 to undergo a lateral and slight rotational motions, which actuates the assembly of cam 120, rollers 150, 151, and roller cage 140 to undergo linear and/or axial motions, which actuate tie bar 40 to undergo an axial motion, which actuates punch pins 200 of punch element 60 to advance axially into paper insertion slot 21. The cam-and-roller assembly in most instances moves in a direction having a lateral component and an axial component. There are portions of the cutting stroke where in the movement of the cam-and-roller assembly only one of the motion components is present. Importantly, the summary descriptions of linkage and machine component movements are intended only as a general explanation of the operation of the preferred embodiment. It should be recognized that the linkages and components may or may not undergo additional dynamic movements such as shifting, twisting, pivoting, sliding, jogging, etc., in directions not specifically mentioned, and the sequence of events of these linkages and components may be rearranged.

Cutting pins 200 may in an alternative embodiment be replaced by a cutting implement such as a flat, edged blade, or the like (not shown). In such an alternative embodiment, the device functions as a paper cutter to make a cut across one sheet or a stack of papers instead of forming one or more holes in those papers. Thus, the same cam 120 and tie bar 40 arrangement can be used to drive the edged blade against the stack of papers to make a linear cut across those papers. Specifically in FIG. 4, tie bar 40 may include an elongated sharp cutting edge at its edge facing slot 21 to replace the illustrated flange that includes edges 44. The punch element would be omitted in this embodiment. Then the sharp edge of the tie bar moves into slot 21 to splice any papers or sheet media held within the slot.

Cam-Roller Structures

Figure 6:
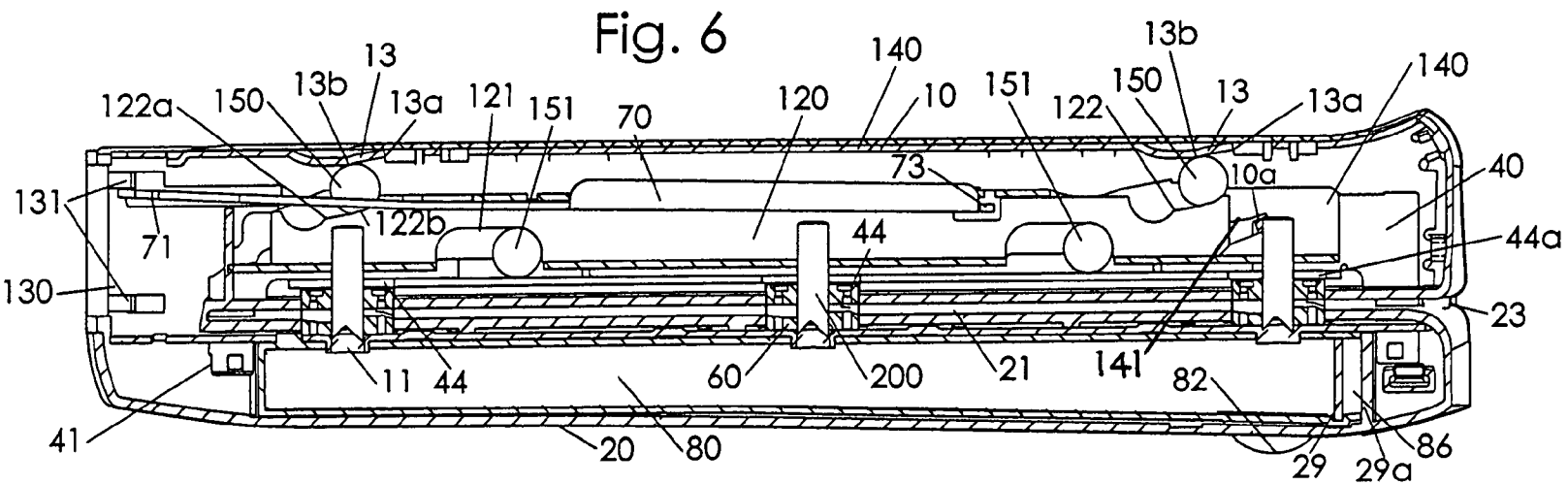
FIG. 6 is a top plan view of the hole punch of FIG. 5, partially in cross-section taken along line 7-7 of FIG. 5.

Returning to the preferred embodiment hole punching device, cam 120 is linked to tie bar 40 by way of rollers 151 as shown in FIGS. 4 and 6. Rollers 151 engage non-angled areas of tie bar 40 and cam 120 thus creating a rolling linkage. As noted above, cam 120 moves laterally in its action as lever 90 pulls it. However, it is preferable to press exclusively axially upon cutting pins 200. Rollers 151 provide a non-sliding, near zero friction and near zero force linkage between cam 120 and tie bar 40, with respect to the lateral motion. Rollers 151 are preferably made from acetal, nylon, polycarbonate, or like rigid polymers; alternatively, die cast metal, powdered metal, and the like are suitable. Therefore, cam 120 presses only axially upon tie bar 40 in the preferred embodiment.

In an alternative embodiment, if rollers 151 were to engage ramps of tie bar 40 in the manner of rollers 150 and cam ramps 13, 122, then cam 120 would cause a lateral force component upon tie bar 40. In fact, such a design may be used if there is preferably a low friction link to react to the lateral force upon tie bar 40. For example, a roller at one end of the tie bar (not shown) could provide a low friction link between tie bar 40 and frame 10; such a roller arrangement would allow axial but not lateral motion of the tie bar.

Figure 24:
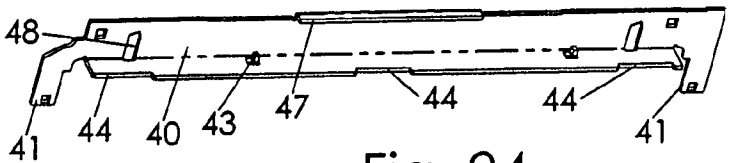
FIG. 24 is a perspective view of tie bar 40.

Rollers 151 are reliably located in the preferred rest position by tabs 43, as seen in FIGS. 4 and 24. The cam-roller system of the preferred embodiment thus provides a compact, rigid leverage action suitable for both light duty punching, and with simple adjustments to ramp configurations and possibly material thickness, heavy duty punching. Moreover, the highest forces are contained near the base of frame 10 against two walls near the corners (left regions in FIGS. 7A and 7B) so that deflection or warping of the punch device is minimized.

In the preferred embodiment, the ramp profiles are not simple, straight angles. Instead, they may include steeper and shallower portions so that the action to move tie bar 40 includes fast and slow movements in relation to moving handle 30. The varying ramp steepness, curvature, humps, etc. provide varying leverage upon cam 120 by handle 30. For example, cam ramp 122 preferably includes corner 122*a* and hump 122*b*, shown in FIG. 6. Frame ramp 13 preferably includes corner 13*a* and hump 13*b*, shown in FIGS. 6 and 6A.

In the rest position of FIG. 4, rollers 150 are positioned in recess 122*c* (FIG. 23) adjacent to the respective corners. As cam 120 moves to the left, rollers 150 immediately engage the corners (FIG. 6A), and cam 120 with tie bar 40 moves relatively rapidly downward and axially (FIGS. 4, 6). In pressed handle position of FIG. 6, rollers 150 are pressing at respective humps 13*b* and 122*b*. In between the corners and humps are less steeply angle parts of ramps 13 and 122. Therefore, in the preferred embodiment, tie bar 40 includes high-speed motions at the start and end of the handle stroke, separated by a central, higher leverage portion of the stroke.

The varying leverage allows an efficient motion of the mechanism of the punch device. In a typical punching operation, the cutting pin moves through an initial low force stroke between the resting position and a start-of-cutting position when pressing against the paper. This motion does not require high leverage. Through the cutting part of the pin stroke, higher leverage is needed. At the end of the stroke, a low force motion moves the paper chips out of the cutting area. Therefore, as discussed above, the tie bar, and thus the pin, move quickly to the start-of-cutting position as roller 150 rolls around the ramp corners. At the end of the stroke, the rollers ride up the humps to help eject the chips away.

Other force profiles may be used. For example, intermediate humps with flatter ramp segments may be used to optimize the motion to specific force peaks during the cutting part of the stroke. Other cam or lever actions (not shown) may be used to allow handle 30 to apply varying leverage force to cutting pins 200. So through the aforementioned adjustments, the movement of and the force needed at the handle can be synchronized with the amount of force needed as the punch pins cut through a stack of papers.

Generally, providing varying leverage force allows the most economical use of a user's input effort or manual pressing force. Indeed, the handle stroke can be reduced over that of a constant leverage design. A constant leverage design requires the handle to have high leverage throughout the stroke to overcome transient peak force requirements. The stroke is necessarily long as a result, including through portions where only low force is actually required. The force at the handle varies directly as the force required at cutting pin 200 changes. But in a varying leverage design, the handle provides high leverage only where needed, with short handle stroke segments allowing large pin motions where possible. The force required to operate the handle is relatively constant through the handle stroke even as the force required at pin 200 changes.

Other benefits are that a reduced the handle stroke and associated rest position handle height are possible. As a result, a smaller, more compact punching device can be constructed having equal cutting power to the more bulky, constant leverage punching devices.

Figure 5:
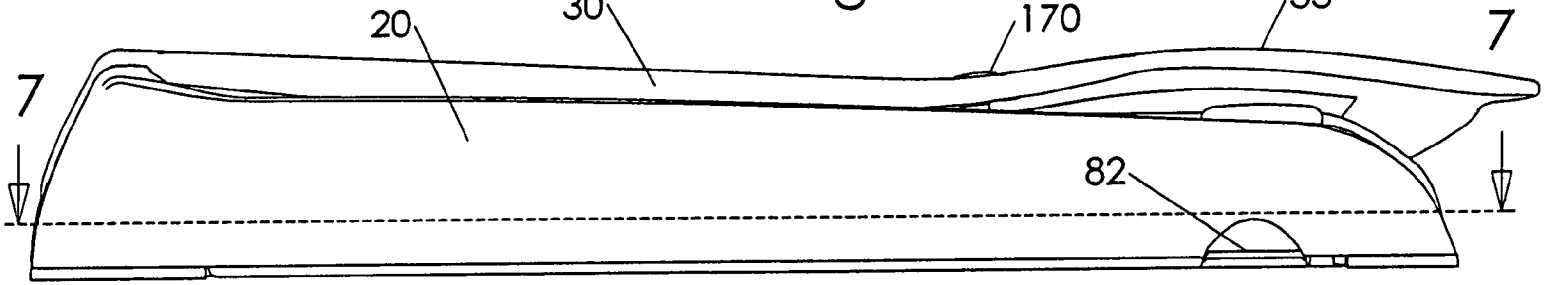
FIG. 5 is a front elevational view of the hole punch in the pressed position.

The cam-roller mechanism fits in a compact frame in the pin axial direction as shown in FIG. 6. It is also desirable to minimize the height of the punch device in a handle pressed or latched position, as seen in FIGS. 5 and 14.

As seen in FIGS. 13 and 14, lever 90 is preferably configured to rotate more quickly than handle 30, as noted above. This difference in rotation rate allows a large translation of link 70 by tab 95 of lever 90, with a limited handle stroke. In other words, for a short stroke that handle 30 travels, lever 90 moves much farther in that same stroke, which lever 90 translates link 70 a greater distance. If handle 30 were directly linked to lever 90, the uppermost position of handle 30 would need to be much taller than that shown in FIG. 13 to provide sufficient handle rotation required for the same amount of link 70 translation.

The translation distance of link 70 relates to the steepness of the roller ramps 13, 122. A longer translation distance of link 70 allows shallower ramps for a given axial travel of pins 200. Shallower ramps lead to increased leverage at rollers 150 and a lower force upon link 70 and the connected components, such as lever tab 95, hinge 91*b*, roller cage 120, etc. Lower magnitude forces acting on these components permits the use of lighter components. Shallower ramps are possible with larger motion of link 70, and thus beneficial use of lever 90.

Optionally, ramps 13, 122 may be steeper. Then the translation distance of link 70 is shorter for a given distance of pin travel. In this instance, lever 90 and handle 30 may be directly linked or may be the same component.

Another way to increase the travel of link 70 by tab 95 is to increase the vertical distance between tab 95 and hinge 91*b*. This requires a taller punch device at the left end in FIG. 14.

Link 70 is preferably elongated. In the embodiment illustrated in FIG. 13, link 70 is more than half as long as the punch device. In FIGS. 4 and 6, it is seen that link 70 changes its angular orientation relative to frame 10 as the assembly moves to the rest position, but the angle change is preferably slight. A shorter length of link 70 would cause this angle change to increase. A large angle change can adversely affect the cutting pin's axial direction forces on roller cage 140 or the cam, which includes the combined cam 120 with roller cage 140.

In the preferred embodiment, lever roller 100 provides a low friction, movable connection between handle 30 and lever 90, as seen in FIGS. 13 and 14. FIG. 21 is a perspective view of lever roller 100 having inner diameter 102 and outer diameter 103. In FIG. 13, 14, handle ramp 36 adjacent lever roller 100 presses outer diameter 103 of lever roller 100. Inner diameter 102 presses edge 91 of lever 90. See also FIG. 8. Handle ramp 36 and edge 91 are respectively angled so that, through lever roller 100, the distal end of lever 90 moves downward away from handle 30 as the handle is pressed. Lever 90 thus rotates faster than handle 30 according to this embodiment.

As illustrated, the profiles of handle ramp 36 and edge 91 are continuous. Optionally, those profiles may include steeper and shallower segments. In this manner, the speed at which lever 90 rotates with respect to handle 30 may vary. Similar benefits as described for ramps 13 and 122 can occur, wherein varying force needs at pins 200 are evened out at handle 30 by having steeper and/or shallower segments in the profiles of handle ramp 36 and edge 91.

Lever roller 100 includes a larger diameter 103 and a smaller diameter 102, which together form a circumferential groove in the roller (FIG. 21). During assembly, lever roller 100 is placed on edge 91 of lever 90 so that edge 91 fits in the groove. Optionally, a slot is formed above edge 91 of lever 90 by a further tab, as shown FIGS. 8, 21, to better retain the roller for assembly. Lever roller 100 is then held in position for assembly. In an alternative embodiment (not shown), the larger diameter portion of the lever roller may be centrally disposed with smaller diameter portions to each side of the larger portion. Then the lever roller rests on two edges of a channel, i.e., two parallel edges 91.

In the preferred embodiment, lever roller 100, frame roller 150, and/or tie bar roller 151 are a simple cylinder resting on one or more flat edges around its circumference. Other roller configurations are contemplated such as a donut or annulus, a ball bearing having a spherical shape, a cylinder with a raised circumferential edge, etc.

Furthermore, the various rollers in the embodiment shown in FIG. 8 are preferably loosely confined elements. That is, the rollers are free to rotate and move along confined paths contained in a plane parallel to the circular face of the roller. Without the confining structures in the direction perpendicular to the co-planar direction, the roller might tip over.

In various alternative embodiments, one or more rollers may be configured as a wheel with a fixed axle. For example, cam 120 may include an axle (not shown) that supports a rotatable wheel. The wheel-with-axle rolls on frame ramp 13 or tie bar 40 in a non-sliding link. For the frame roller ramp 13, the ramp incline would need to be steeper to provide the same motion at cutting pins 200 since there is no compounding action from the two opposed ramps 13, 122, which ramps are omitted when an axle is used with the wheel. To illustrate, if a wheel-with-axle were mounted to cam 120, ramp 122 would not contact the wheel, and such a ramp of the cam would not be required. Then only ramp 13 provides the required pin-axial motion, rather than both ramps 13 and 122 in the illustrated, non-axle-equipped roller 150.

Alternatively, the frame may include an axle supporting a wheel, and the wheel rolls along a cam ramp. In this embodiment, handle 30 may support an axle (not shown) near the illustrated handle ramp 36. A wheel link would roll on edge 91 or equivalent structure. A simple axle structure may include normal sliding at or near the axle/wheel interface. In that case, there is some sliding with respect to the component to which the axle is fixed, but normally no sliding at the interface of the outer diameter of the wheel. The meaning of "no sliding" includes minimal sliding, skidding, and/or skipping of the wheel or roller against a surface, and implies that wheel or roller provides a very low friction link or interface.

Lever 90 includes hinge 91*a* fitted into opening 14*a* of frame 10 as seen in FIG. 8. Hinge 91*b* fits into opening 14*b*. Edge 91, tab 95, and hinge 91*b* of lever 90 define a force plane, effectively a flat sheet shape upon which most of the actuation force is applied. Lever 90 is therefore rigid in a simple sheet metal structure. Hinge 91*a* is spaced from the force plane and primarily gives stabilization of lever 90. Optionally, tab 95 may include other structures such as an opening in lever 90 fitting a tab of frame 10, or a separate pin component to form a hinge. In the preferred embodiment, lever 90 is assembled to frame 10 by temporarily spreading apart the frame walls that include hinges 91*a* and 91*b*, fitting the lever 90 within the space, and allowing the walls to spring back.

Figure 20:
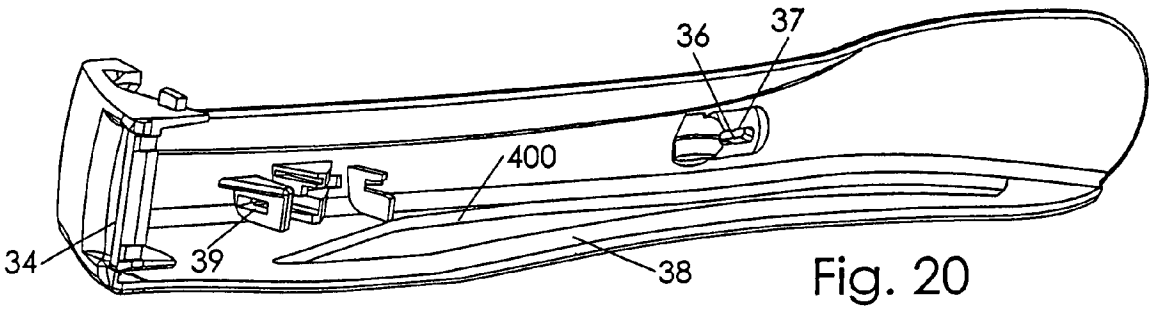
FIG. 20 is a bottom perspective view of handle 30.

As best seen in FIGS. 8, 13, and 20, as lever 90 is stabilized, it also helps position handle 30. That is, extension 99 of lever 90 passes through slot 39 of handle 30 in a close, sliding fit. Handle 30 is secured from excess sideways motion (in/out of page in FIG. 13) by a front constraint at extension 99 and a rear constraint at rib 34 in hinge tab 12. Hinge tab 12 alone can provide some sideways stability since it is elongated across a width of handle 30, but adding the front connection at extension 99, or other nearby areas of lever 90, creates a more stable handle operation.

Punch Element

According to the punch element illustrated here and disclosed in co-pending it is desirable that pin 200 can be retracted directly, rather than exclusively, by the force of a return spring. Such a punch element is disclosed in U.S. patent application Ser. No. 11/215,423, filed Aug. 30, 2005, titled "Hole Punch Element," by Joel S. Marks, whose entire contents are hereby incorporated by reference. As discussed in the referenced application, a lighter return spring may be used if the spring does not have to retract the pin in all cases. Rather, in some cases, a user can pull up on handle 30 to retract a jammed pin. This is accomplished by the following action: handle 30 when lifted upward is linked in tension to (i.e., pulling up on) lever 90 at extension 99 in slot 39. Slot 39 includes a cross rib (FIG. 20) to engage extension 99 in its upward travel. Link 70 normally operates in tension between lever 90 and roller cage 140, but can also push on roller cage 140 through the pivoting links at each end. It is therefore possible to pull up on handle 30 and force roller cage 140 and cam 120 toward the rest position (rightward in FIG. 13) thus retracting the cutting pins 200.

Rollers 150 operate in compression only so they cannot normally cause tie bar 40 to retract. Various features may be added to the rollers to allow such function such as axial extensions from the roller to fit slots of frame 10 and roller cage 140 (not shown).

In the preferred embodiment, tab 10*a* of frame 10 slidably engages slot 141 of roller cage 140 (FIGS. 4, 5, 8, 17 and 26). In FIG. 8, the two slots 141 are shown in phantom lines at the opposite ends of roller cage 140, and each slot has an incline relative to the length of roller cage 140. There are preferably two such tab 10*a* and slot 141 engagements but more or fewer are contemplated.

In FIGS. 4 and 6, partial views of tab 10*a* in slot 141 depict the operation. In FIG. 6, tab 10*a* is slightly spaced from the edge of slot 141. There is no contact in normal operation of the sliding engagement; the rollers provide the low friction cutting pin pressing function. However, if it is required to pull up on tie bar 40, pulling handle 30 up moves roller cage 140 directly to the right through lever 90 and link 70 until tab 10*a* engages slot 141. In FIG. 4, near the rest position, this contact engagement is seen near the right end of frame 10. With. tab 10*a* caught in slot 141, roller cage 140 is forced upward to retract cutting pins 200 as roller cage 140 continues to move rightward. Rollers 151 are loose during retraction, and the cam-roller cage assembly 120, 140 slidably presses tie bar 40 at rib 47 in FIGS. 7A, 7B, and 8. Tie bar 40 and cutting pins 200 are thereby urged to retract. Retraction includes sliding engagements between slots 141 and tabs 10*a* (FIG. 4), and between extension 99 of lever 90 and slot 39 (FIG. 13). This is acceptable for the low forces normally required to unjam pins 200 from being stuck in a punched hole.

Figure 11:
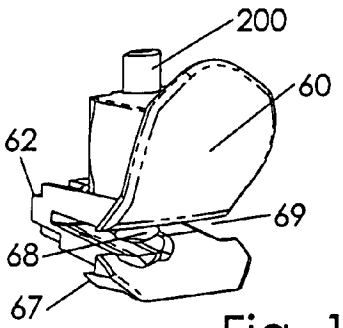
FIG. 11 is a front, side perspective view of punch element assembly 60.

According to a preferred embodiment of the present invention seen in FIGS. 1-2, paper slot 21 opens upward in normal use on a desktop. Paper slot 21 extends longitudinally along the length of the punch device to preferably form a smooth, continuous slot that incorporates punch element slots 69 (FIGS. 7A, 11). Optionally, punch element slots 69 may largely or entirely define the position of the paper slot if, for example, paper slot 21 of cover 20 were modified or omitted.

Figure 12:
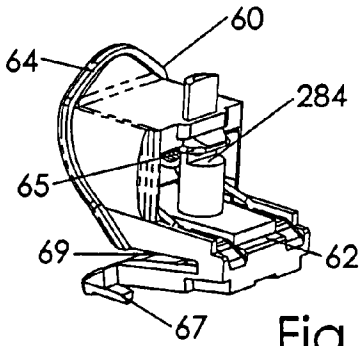
FIG. 12 is a side, rear perspective view of punch element assembly 60 of FIG. 11.

Punch elements 60 are held to frame 10 at ribs 67 under tabs 17 of frame 10, as seen in FIGS. 7B, 12, and 17. The lower part of punch element 60 extends to opening 15 of frame 10, as seen in FIGS. 7A and 17. Bottom cover 103 is shown in an exploded view of FIG. 8 and in an isolated view of FIG. 16. Rib 132 of bottom cover 130 fits between the edge of opening 15 and face 62 (FIG. 12) of punch element 60 to lock the punch element into position thereon. Tab 18 of frame 10 (FIG. 17) holds punch element 60 from being pulled out. Bottom cover 130 may be attached by snap features, or other means.

In FIGS. 7A, 7B, 11, punch element 60 includes element slot 69 that is preferably aligned with paper insertion slot 21 for the entire device. Die hole 68 of the punch element is aligned with opening 11. The mechanism of the punch device returns from the pressed position to the rest position under the bias of return springs 65 within the punch elements (FIG. 12). Additional return springs may be used, for example, a return spring may be directly linked to handle 30 to bias it back to the rest/start position. The return springs may be one or any combination of helical compression or tensile coils stacked or co-axially arranged, one or more bar springs in bending, one or more torsion springs, or the like.

Punch element 60 is illustrated preferably as a discrete component, of which there are three in the hole punch device. Of course, there may be more or fewer than the three shown, and the punch elements may be integrated into a unitary piece that can operate in unison to cut multiple holes. Furthermore, the functions of the punch element or elements may be equivalently incorporated or integrated into part of frame 10, cover 20, or other components of the punch device. A preferred embodiment punch element is illustrated and described, but features of other punch elements known in the art may be used with the present invention.

Figure 19:
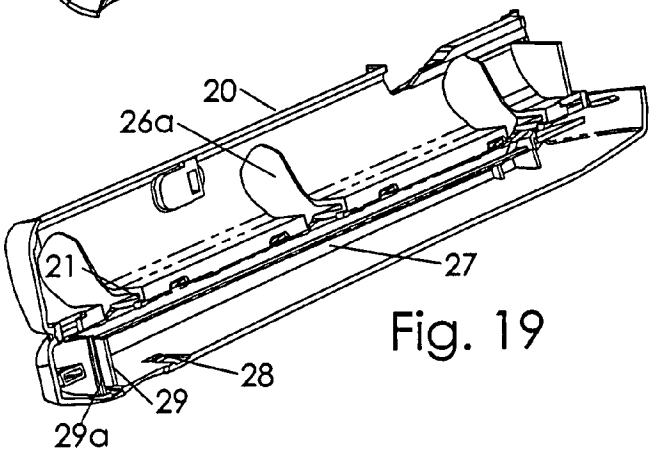
FIG. 19 is a bottom perspective view of cover 20.

Punch elements 60 may further be used to secure cover 20 in position, as best seen in FIGS. 8 and 19. Openings 26*a* include perimeter 26. Punch element 60 includes flange 64 (FIG. 12), and flange 64 contacts perimeter 26 (FIG. 7B) in the three punch element positions shown. Cover 20 is thereby held in position with a minimum of additional fasteners or assembly devices.

FIG. 8 shows tie bar 40 in an exploded view of the entire hole punch device, and FIG. 24 shows tie bar 40 in an isolated view. Tie bar 40 includes extensions 41 that fit through openings 16 of frame 10 (FIG. 17). Tie bar 40 is thereby stabilized within the assembly. Alternatively, tie bar 40 may of course be welded, bonded, brazed, fastened or similarly anchored to frame 10.

Roller 151 and pin 200 are preferably aligned at pin slot 284 as shown in FIG. 7A. This alignment is with respect to the distance from the axis of cutting pin 200 in the view of FIG. 7A. In this preferred arrangement, any twisting or non-pin-axial forces of tie bar 40 are minimized. If roller 151 presses too far from slot 284, and thus the cutting pin axis, the non-aligned opposing forces will torque tie bar 40.

Figure 28:
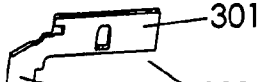
FIG. 28 is a perspective view of low friction clip 300 optionally used to cover extension 41 of tie bar 40 of FIG. 24.

To the extent that there are non-axial forces on tie bar 40, extensions 41 of tie bar 40 may optionally have a low friction material around them. An example of such a low friction material is clip 300 shown in FIG. 28. Clip 300 may be made in part or completely of acetyl plastic or other material, and covers both faces of tie bar 40 near extensions 41 (FIG. 24). Low friction guide 302 of clip 300 is provided for extensions 41 to interface with openings 16 of frame 10. Upper portion 301 provides a low friction guide for tie bar 40 moving against the interior of frame 10 and against roller cage 140. Tie bar 40 include slots 48 (FIG. 24) through which tabs 10*a* in frame 10 (FIG. 17) can pass. Edge 44 (FIGS. 4, 24) of tie bar 40 engages slots 284 (FIG. 12) of pin 200.

Chip Chamber

Handle 30 extends from a hinge end at rib 34 to pressing end 33. In at least in some operating positions such as the pressed position of FIG. 2, handle 30 is substantially parallel and adjacent to or along side paper slot 21. Chip chamber 27 also extends along side paper slot 21, opposite the slot from handle 30 (FIG. 7). Chips are expelled through opening 11 of frame 10 into chip chamber 27. Alternatively, handle 30 extends past a second end of frame 10 and/or cover 20 (the right end in FIG. 5) so that pressing area 33 partly overhangs in the pressed position. Flange 20*a* of cover 20, at lever 90, protects the interior of the punching device from stray chips or other debris.

Figure 10:
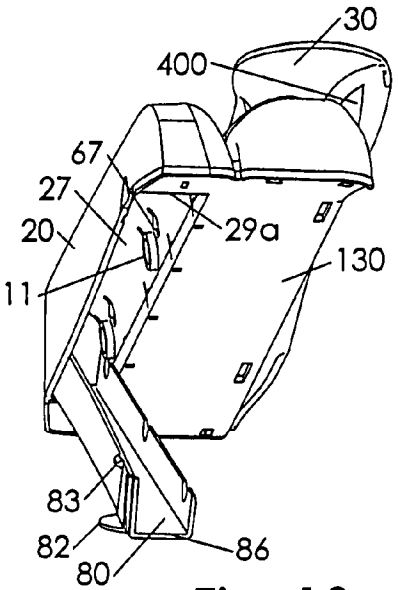
FIG. 10 is an end perspective view of the hole punch device in the pressed position, with the chip tray in the lowered position as in FIG. 9.

In FIGS. 4 and 10, chip tray 80 preferably includes a "U" channel cross-sectional shape and forms the bottom of chip chamber 27 to hold chips for storage. Chip tray 80 is pivotably attached at chip chamber 27. Hinge post 84 of chip tray 80 extends into hole 19 of frame 10 (FIG. 17) of chip chamber 27. Chip tray 80 may then be snapped into position at hinge 84 and hole 19. Optionally, a second hinge (not shown) may extend oppositely into a recess of a wall of chamber 27. Other pivoting attachments may be used. For example, a separate hinge pin may be inserted to pivot in the respective holes.

Figure 9:
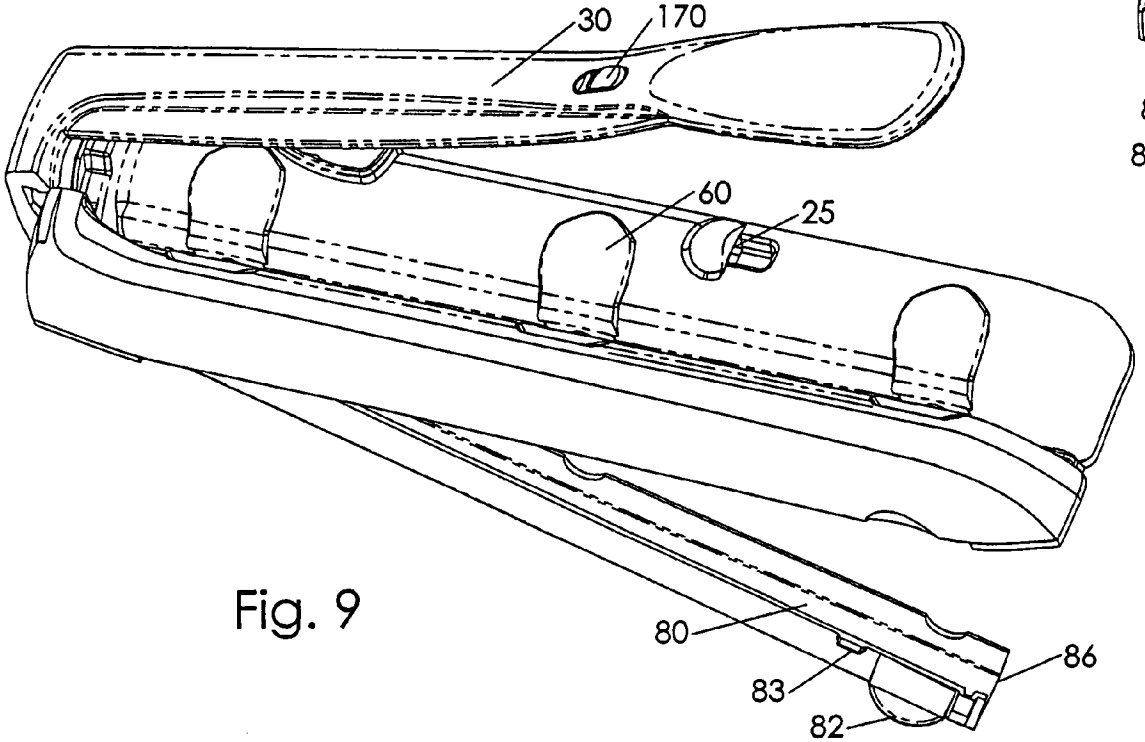
FIG. 9 is a top, front end perspective view of the hole punch device of FIG. 1 in the rest position, with a chip tray lowered to an opened position.

To empty the chips, tray 80 is pivoted to a lowered position (FIGS. 9, 10) to expose the interior of the chip tray. The chips then slide out for disposal. If the chips are compressed from overloading such that they do not easily empty out, the tilt-open tray allows easy access by a finger, a pen, or the like to sweep or urge the chips out. Furthermore, the extended chip tray can be gently tapped to shake chips out.

The user may apply force at optional tab 82 to pull chip tray 80 to its lowered open position. Catch 83 fits into recess 28 (FIG. 19) to retain chip tray 80 selectively in the upper closed position. Other equivalent catch, snap, hooked, spring-biased, or frictional structures may be used. In various alternative embodiments, chip chamber 27 may include a fixed floor (not shown) with an operable trap door in the floor, at an end, or other wall of the chamber to selectively expose the interior of the chamber for emptying the chips. Chip chamber 27 may optionally be open in a side direction (not shown) so that chip tray 80 opens sideways. In this case, a user may turn the punch device so that chip tray 80 actually opens downward allowing gravity to help in emptying the chamber.

Cover 20 includes ribs 29 and 29*a* to provide a double end seal for chip tray 80 when the tray is in the closed position of FIG. 1, 4, 6, or 19. Rib 29 fits within the channel of chip tray 80 near open end 86 while rib 29*a* covers open end 86 as seen in FIG. 10. Either rib 29, 29*a* may optionally function alone. The ribs are preferably fixed in relation to the punch device. Chip tray 80 lowers away from ribs 29, 29*a* so the ribs do not inhibit emptying the chips when the tray is lowered to the open position of FIGS. 9 and 10. This preferred embodiment design thus provides an advantage over a design where chip tray 80 is enclosed at distal end 86 by a fixed rib of the tray.

In FIGS. 4 and 10, it is seen that chip tray 80 preferably includes a draft wherein it becomes wider toward its open end 86 at the distal end of the tray near tab 82. The distal end is opposite the end with hinge post 84. The draft may, for example, be from about 1° to 10° inclusive including all angles contained within those limits. More preferably, the draft angle ranges about 3° to 4°. The draft in chip tray 80 allows chips to more easily slide out of chip chamber 27, and the preferred angles are chosen for that effect without adversely affecting the overall dimensions and operation of the of the punch device.

In another alternative embodiment, chip chamber 27 may include a storage area (not shown) below frame 10 along the left side in FIGS. 7A, 7B. In this embodiment, the chamber may form an "L" shape (in the orientations of FIGS. 7A, 7B) with the lower leg of the "L" serving to connect the bottom storage area to openings 11. The punch device would then be taller overall with increased chip storage capacity. Chip tray 80 may then span the width of the punch device to cover the enlarged chip chamber.

Handle Latch and Handle

Figure 18:
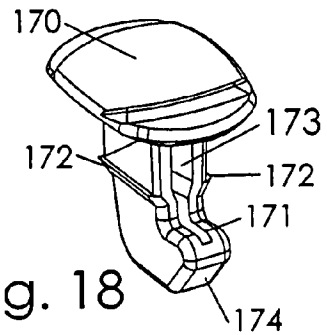
FIG. 18 is a perspective view of latch 170 used to lock handle 30 in its lower most position.

Optional latch 170 selectively holds handle 30 in the lower most position (FIG. 2). The punch device can thus be stored and carried easily. In the exemplary embodiment, latch 170 is slidably fitted atop handle 30 in slot 36 (FIGS. 13, 18, and 20). As seen in the isolated view of FIG. 18, latch 170 includes open core 173 and ribs 172. The latch is flexible at ribs 172 by inward deflection of outer walls of core 173. The latch can be squeezed to draw the opposed ribs closer. For assembly, latch 170 is pressed into slot 36 in handle 30 (FIG. 20); ribs 172 resiliently deflect to allow the latch to pass into position. At the final position of latch 170 in handle 30, with assembly pressure removed, ribs 172 snap back into a normal shape at edges 37 (FIG. 20). Alternatively, the material of handle 30 may be selected to resiliently deflect for assembly.

It is possible that a user may press handle 30 to the lower most position while latch 170 is in the alternate left, latched position from that shown in FIG. 13. In that instance, tapered face 174 engages the upper edge of rib 25 which forces latch 170 to the right (in FIG. 13) toward the unlatched position. Handle 30 can then move fully to the position of FIG. 14, with latch 170 in the right, unlatched position of FIG. 13. The latch then may be moved leftward to the latched position as shown in FIG. 14 if desired. Otherwise, handle 30 is released to rise upward. Other locations and types of latches known in the art may be used.

Figure 15:
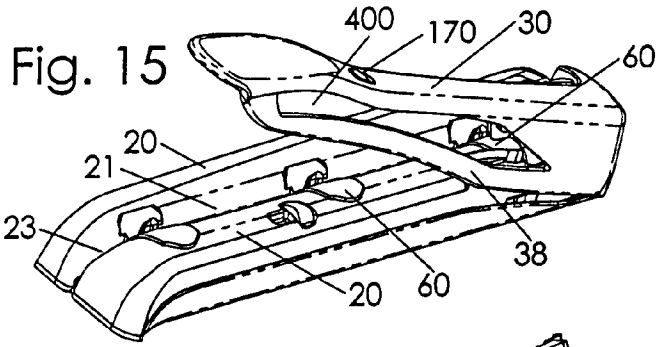
FIG. 15 is a back perspective view, with the hole punch device in the rest position.

As seen in FIG. 15, handle 30 includes optional viewing window 400 in the vertical wall of the handle to assist viewing the punching operation on a stack of papers or sheet media. Handle 30 may be constructed of a parent material including a glass filled plastic such as acrylonitrile-butadiene-styrene (ABS), polycarbonate (PC), or like thermoplastic material. Window 400 may be empty or may be filled with a clear plastic material, such as non-filled ABS or PC to form an enclosed insert in the parent material of the vertical wall. Beam 38 under window 400 may be of the stiffer glass filled material. In this preferred embodiment, handle 30 has a modified I-beam structure with strong upper and lower beams, connected by a less strong central web (i.e., window 400). Alternatively, if window 400 is empty, a series of ribs of the parent material may span window 400 to connect the upper and lower portions. Of course, all or portions of handle 30 may be plastic or stamped or cast metal.

Figure 16:
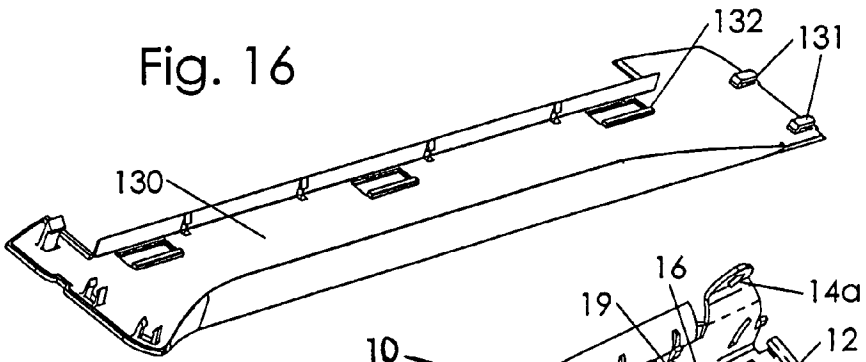
FIG. 16 is a back perspective view of bottom cover 130.

Handle 30 has hinge rib 34 (FIG. 20) for assembly to hinge tab 12 of frame 10 (FIG. 17) at hinge rib 34 (FIGS. 7C). Hinge tab 12 includes a recessed area to cover and engage hinge rib 34. Hinge rib 34 is held up within the recess of hinge tab 12 by tabs 131 of bottom cover 130 (FIG. 16). As seen in FIG. 7C, handle 30 cannot move downward because of the presence of tab 131. Normally, bottom cover 130 is assembled after handle 30. Hinge tab 12 may be continuous as shown or have separate segments to provide an equivalent elongated structure. Bottom cover 130 may be removed if desired to move tabs 131 away and allow for removal of handle 30 from hinge tab 12. Other components may comprise tabs 131.

As illustrated, the punch device preferably includes a vertical entry paper slot 21. The features and benefits of the present invention are applicable to a horizontal entry paper slot embodiment too. For example, frame 10 could be rotated 90° to have slot 21 facing out of the page in FIG. 3. In such an embodiment, hinge tab 12 of the frame would be rotated about 90° also. Further, openings 14*a* and 14*b* would be aligned at 90° to the exemplary embodiment. Then handle 30 would move downward along the page in FIG. 7.

It is understood that various changes and modifications of the preferred embodiments described above are apparent to those skilled in the art. Such changes and modifications can be made without departing from the spirit and scope of the present invention. It is therefore intended that such changes and modifications be covered by the following claims.

I claim:

1. A hole punch device for creating hole in sheets of paper, comprising:

an elongated frame having a paper slot, wherein the paper slot extends lengthwise along a length of the punch device from a first end of the frame to a second end of the frame, the paper slot being open vertically toward a top of the punch device to enable a substantially vertical entry by the sheets of paper into the paper slot;

a punch pin having an axial direction and movable along the axial direction across the paper slot;

a handle supported on the frame, wherein the handle is cantilevered from a proximal handle end at the first end of the frame to a distal handle end, wherein the handle is hinged only at the proximal handle end and the handle extends along the length of the frame including a pressed handle position wherein the distal handle end is adjacent to the paper slot and the handle extends along the top of the punch device adjacent to and substantially parallel to the paper slot, and a rest handle position wherein the distal end of the handle is spaced away from the paper slot such that the handle is angled relative to the paper slot;

wherein the handle is hinged on a pivoting axis extending in the axial direction; and a rotating element linked to the handle and the punch pin, wherein pressing the handle to pivot causes the rotating element to move in the handle lengthwise direction and in the axial direction thereby moving the punch pin across the paper slot.

2. The hole punch device of claim 1, wherein the handle extends to the second end of the punch device.

3. The hole punch device of claim 2, wherein the handle extends past the second end of the punch device.

4. The hole punch device of claim 1, wherein a chip chamber extends along side the paper slot.

5. The hole punch device of claim 4, wherein the chip chamber is positioned opposite the paper slot from the handle.

6. The hole punch device of claim 4, wherein a chip tray forms a bottom of the chamber, and wherein the chip tray is pivotably attached to the chip chamber at a first end of the chip tray so that the chip tray includes a lowered position pivoted downward from the punch device to expose an interior of the chip tray.

7. The hole punch device of claim 6, wherein the chip tray is open at a second, distal end of the chip tray, and the chip tray includes a draft wherein the chip tray becomes wider from the first end toward the second end.

8. The hole punch device of claim 1, wherein a wall of the handle includes an opening to form a window.

9. The hole punch device of claim 8, wherein a clear material at least partially fills the window to form an enclosed insert in a parent material of the handle.

* * * * *